US005299683A

United States Patent [19]

Poole

[11] Patent Number: 5,299,683

[45] Date of Patent: Apr. 5, 1994

[54] SHOWER CADDY

[76] Inventor: Ronald E. Poole, 208 Bloomingdale Rd., Kitchener, Ontario, Canada, N2K 1B1

[21] Appl. No.: 91,771

[22] Filed: Jul. 14, 1993

[51] Int. Cl.[5] ..... A47K 5/06

[52] U.S. Cl. ..... 206/77.1; 206/581; 206/806; 132/315

[58] Field of Search ..... 206/581, 228, 229, 77.1, 206/806, 823; 222/83.5, 561; 132/286, 289, 290, 291, 314, 315

[56] References Cited

U.S. PATENT DOCUMENTS

| | | | |
|---|---|---|---|
| 2,411,196 | 11/1946 | Dolan | 132/315 |
| 4,457,427 | 7/1984 | Cafiero | 206/229 |
| 4,548,572 | 10/1985 | Hoffman | 206/77.1 X |
| 4,611,716 | 9/1986 | Sorlien | 206/77.1 X |
| 4,889,141 | 12/1989 | Lindsey | 206/581 X |
| 5,007,531 | 4/1991 | Lighten | 206/77.1 |
| 5,095,924 | 3/1992 | Stanfield | 206/581 X |
| 5,215,193 | 6/1993 | Dennis | 206/229 X |

*Primary Examiner*—Paul T. Sewell
*Assistant Examiner*—Jacob K. Ackun, Jr.
*Attorney, Agent, or Firm*—Hugh E. Smith

[57] ABSTRACT

A shower caddy which comprises: a rigid, hinged, two-part external case; a plurality of holders for toilet articles disposed within and fastened to the interior of said case; fluid dispensing means arranged within and fastened to said case, said means having provision for replacement of plastic, fluid containers mounted on said means; and hinged rotatable hook members external to and extendable from one part of said case to engage with a shower curtain support rod to permit hanging such case therefrom.

2 Claims, 3 Drawing Sheets

SHOWER CADDY

BACKGROUND OF THE INVENTION

1. Field of the Invention

The present invention relates to shower caddies and more particularly pertains to such devices which may be hung from a shower curtain rod and which will contain in convenient access form the toilet articles one normally requires.

2. Description of the Prior Art

The use of shower caddies is known in the prior art. More specifically, caddies heretofore devised and utilized for the purpose of hanging in relationship to a shower are known to consist basically of familiar, expected and obvious structural configurations, notwithstanding the myriad of designs encompassed by the crowded prior art which have been developed for the fulfillment of countless objectives and requirements. Usually such items are restricted to their use with bar soap of the like and are not designed for nor convenient for use with other articles. Typical of the prior art are the devices shown in U.S. Pat. Nos. 5,014,860; 4,875,593; 3,923,162; Des. 309,225; Des. 286,599; and Des. 251,522.

In this respect, the shower caddy according to the present invention substantially departs from the conventional concepts and designs of the prior art, and in so doing provides an apparatus primarily developed for the purpose of hanging from a shower curtain rod and containing multiple items of toiletry articles.

Therefore, it can be appreciated that there exists a continuing need for new and improved shower caddy. In this regard, the present invention substantially fulfills this need.

SUMMARY OF THE INVENTION

In view of the foregoing disadvantages inherent in the known types of shower caddy now present in the prior art, the present invention provides an improved shower caddy construction wherein the same can be utilized to hold a plurality of toiletry articles and to depend from a shower curtain rod where it will generally be kept dry. As such, the general purpose of the present invention, which will be described subsequently in greater detail, is to provide a new and improved shower caddy apparatus which has all the advantages of the prior art caddies and none of the disadvantages.

To attain this, the present invention essentially relates to a shower caddy which comprises: a rigid, hinged, two-part external case; a plurality of holders for toilet articles disposed within and fastened to the interior of said case; fluid dispensing means arranged within and fastened to said case, said means having provision for replacement of plastic, fluid containers mounted on said means; and hinged rotatable hook members external to and extendable from one part of said case to engage with a shower curtain support rod to permit hanging such case therefrom.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shower caddy which has all the advantages of the prior art devices and none of the disadvantages.

It is another object of the present invention to provide a new and improved shower caddy which may be easily and efficiently manufactured and marketed.

It is a further object of the present invention to provide a new and improved shower caddy which is of a durable and reliable construction.

An even further object of the present invention is to provide a new and improved shower caddy which is susceptible of a low cost of manufacture with regard to both materials and labor, and which accordingly is then susceptible of low prices of sale to the consuming public, thereby making such devices economically available to the buying public.

Still another object of the present invention is to provide a new and improved shower caddy especially adapted to be hung from a shower curtain rod.

Yet another object of the present invention is to provide a new and improved self-contained shower caddy which will store and carry compactly.

Even still another object of the present invention is to provide a new and improved shower caddy for containing all toiletry articles normally required by a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
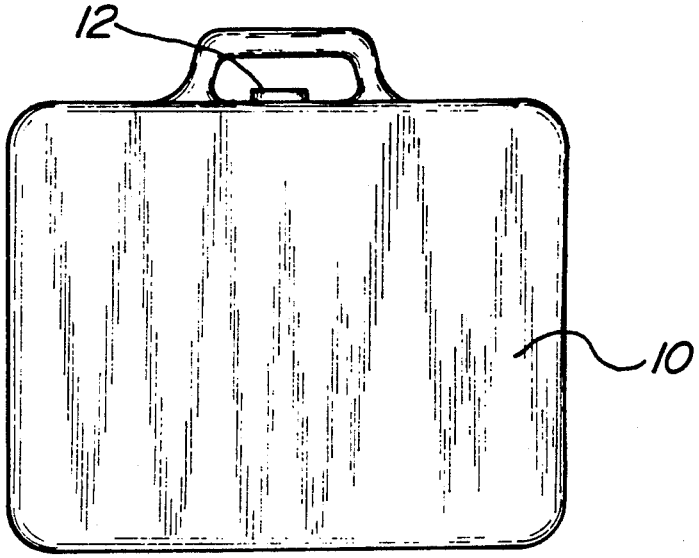
FIG. 1 is a side plan view of the shower caddy of this invention in the closed carry position.
Figure 2:
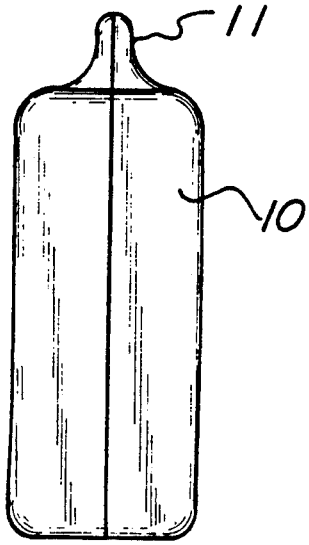
FIG. 2 is an end plan view of the shower caddy case of FIG. 1.

With reference now to the drawings, and in particular to FIGS. 1 and 2 thereof, a new and improved shower caddy embodying the principles and concepts of the present invention and generally designated by the reference numeral 10 will be described.

More specifically, it will be noted that shower caddy 10 may be closed as shown in FIG. 1 and carried like an attache case. A handle 11 is provided along with a snap closure 12.

Figure 3:
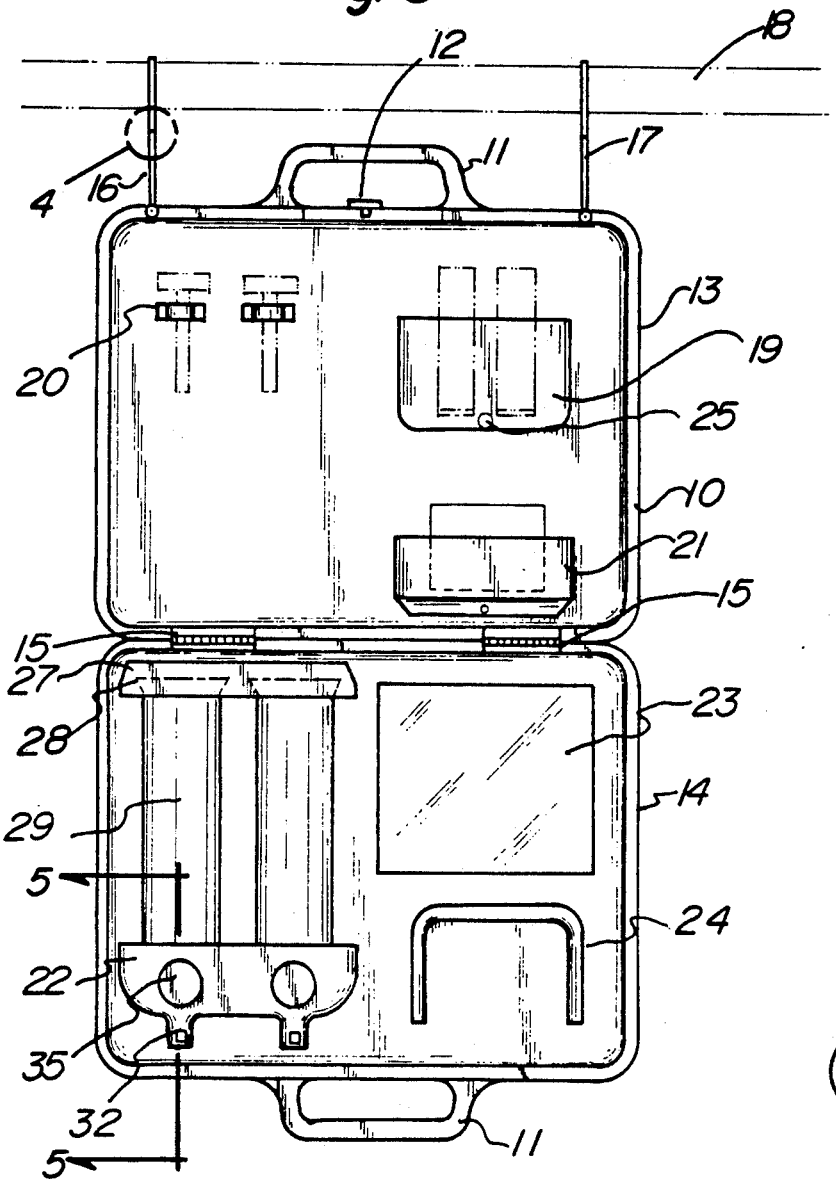
FIG. 3 is a front plan view of the shower caddy of the present invention shown in open and operating configuration.

FIG. 3 shows the shower caddy 10 in open and operable configuration. The caddy 10 has two hinged rigid case sections 13 and 14 hinged at the base thereof at 15. Two extendible hook members 16 and 17 are pivotally mounted at the top of section 13 and adapted to swing upwardly therefrom to engage with a shower curtain rod 18 (shown in broken lines). Mounted within both case sections 13 and 14 are a plurality of article holders such as 19 of various configurations. While such configurations may be changed to accept specific items, as shown in this FIG. 3, holders 20 are designed to support two razors (shown in broken lines); the holder designated by 19 in FIG. 3 to accept bottles such as after-shave or the like; holder 21 to hold a bar of soap; and holder 22 to support plastic tubes of fluids such as shampoo, creme rinse or the like. (This latter holder will be discussed in connection with FIG. 5 below). Other items such as a mirror 23 and a fold-out wash-cloth support rod 24 may be included. It will be noted that holders in the top case section 13 either have an open bottom as with 20 or drain holes 25 as in 19 and 21. This permits water which may accidentally get into such holders to drain down to the base of case section 14 from which it may be readily dumped when the case sections 13 and 14 are to be closed.

Figure 4:
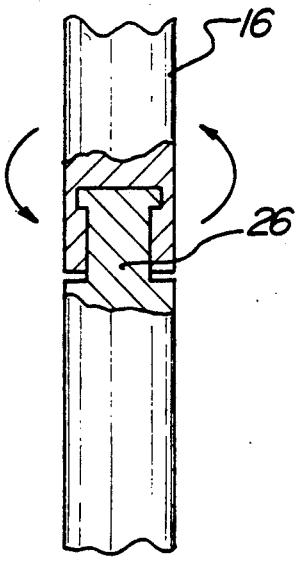
FIG. 4 is a detail view in partial section of one of the support hooks of the present invention (shown in small scale in the circle identified as "4" on FIG. 3).

FIG. 4 shows a detailed view of the mid-section of extension hook 16 illustrating that the upper portion of the same is rotatably connected to the lower portion by a pivotal connector 26.

Figure 5:
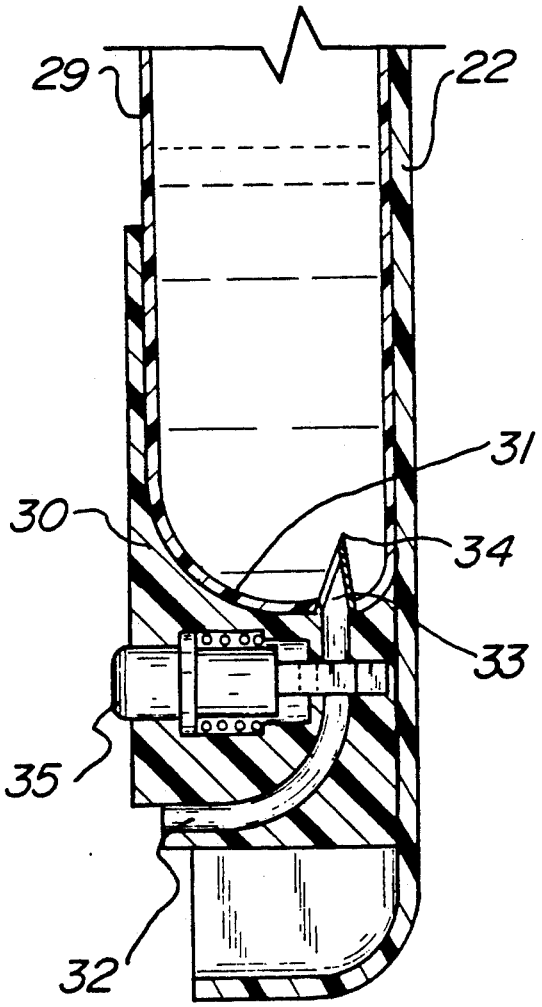
FIG. 5 is a sectional view on line 5—5 of FIG. 3.

FIG. 5 is a detailed sectional view on line 5—5 of FIG. 3 showing how holder 22 is configured. Holder 22 has a top portion 27 (shown in FIG. 3) which engages with and holds one end 28 of a fluid containing plastic tube 29 e.g. shampoo. The bottom portion of holder 22 has a curved receptacle 30 for receiving the other end 31 of such plastic tube 29. Positioned within the curved receptacle 30 is a sharp pointed open tube 32. The sharp point 33 may be comprised of the material of tube 32 or may have a sharp, appexed, open extrusion 34 mounted on such tube. The function of this sharp point 33 is to penetrate plastic tube 29 and allow the contents thereof to enter tube 32. A spring-loaded finger-operated plunger type valve 35 will normally close off tube 32 until the user wishes to dispense the fluid from tube 29. Pushing in the plunger 35 releases the fluid and upon obtaining the desired quantity, release of the plunger causes the spring to push the plunger outwardly, again closing off tube 32. As shown, the configuration of this FIG. 5 is duplicated in side-by-side units.

As to the manner of usage and operation of the present invention, the same should be apparent from the above description. Accordingly, no further discussion relating t the manner of usage and operation will be provided.

With respect to the above description then, it is to be realized that the optimum dimensional relationship for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved shower caddy comprising: a rigid, two-part external case the two parts hinged to each other; a plurality of holders for toilet articles disposed within and fastened to said case; means for dispensing fluids arranged within and fastened to said case, and means within said case for removably supporting a plastic fluid container within said fluid dispensing means whereby fluid from said plastic container is dispensed through said dispensing means; a plurality of hook members hingedly attached to one part of said case and extendable therefrom by means of said hinged attachment to engage with a shower curtain support rod to permit hanging such case therefrom, each of said hook members comprising an upper portion and a lower portion connected thereto at a mid section of each of said hook members comprising an upper portion and a lower portion connected thereto at a mid section of each of said hook members, said upper and lower portions at each said mid section being generally rod shaped and connected to each other in end to end fashion along a longitudinal axis therethrough by a pivotal connector, wherein said upper portion is pivotable relative to said lower portion about said longitudinal axis.

2. A shower caddy as in claim 1 wherein said fluid dispensing means comprises a receptacle for supporting at least one fluid containing plastic tube therein; a sharp-pointed hollow tube disposed at the base thereof to puncture said plastic tube and to allow fluid therefrom to enter said hollow tube; closure means on said tube to control flow therein, said closure means when opened allowing fluid to be dispensed from the end of said hollow tube.

* * * * *